US005340230A

United States Patent [19]

Anderson

[11] Patent Number: 5,340,230

[45] Date of Patent: Aug. 23, 1994

[54] SEAMLESS WIRE CONNECTOR

[75] Inventor: John R. Anderson, Sandy Hook, Conn.

[73] Assignee: Osram Sylvania Inc., Danvers, Mass.

[21] Appl. No.: 998,693

[22] Filed: Dec. 30, 1992

[51] Int. Cl.[5] ..... H01R 4/00

[52] U.S. Cl. ..... 403/300; 403/308; 439/879; 24/115 M; 174/74 R

[58] Field of Search ..... 439/799, 879, 891, 888, 439/874, 730, 161; 24/115 M, 129 W, 136 R; 174/84 C, 83, 74 R; 403/300, 308, 314

[56] References Cited

U.S. PATENT DOCUMENTS

| | | | |
|---|---|---|---|
| 2,305,234 | 12/1942 | Bratz | 24/136 R |
| 2,385,915 | 10/1945 | Hagedorn et al. | 439/874 |
| 3,034,094 | 5/1962 | Watson | 439/888 |
| 3,200,190 | 8/1965 | Forney, Jr. | 174/84 C |
| 4,913,661 | 4/1990 | Gellenthin, Jr. et al. | 439/891 |
| 5,137,478 | 8/1992 | Graf | 439/874 |

FOREIGN PATENT DOCUMENTS

| | | | |
|---|---|---|---|
| 728305 | 2/1966 | Canada | 174/84 C |
| 2386171 | 12/1978 | France | 174/84 C |
| 593526 | 10/1947 | United Kingdom | 174/74 R |
| 1579734 | 11/1980 | United Kingdom | 439/161 |

*Primary Examiner*—Randolph A. Reese
*Assistant Examiner*—Anthony Knight
*Attorney, Agent, or Firm*—William H. McNeill

[57] ABSTRACT

A connector is provided formed from an elongated seamless tubular member having a first segment to which a conductor may be attached and opposite second segment which comprise a male connector end or a female connector end. The conductor is attached to the tubular member by providing a groove or crease in the first segment. The conductor lead is disposed in such groove and, the first segment is then crimped to hold the lead in place relative to the conductor. Alternatively, the lead may be soldered to the groove or sandwiched between the groove and a sleeve positioned upon the first segment.

19 Claims, 4 Drawing Sheets

SEAMLESS WIRE CONNECTOR

BACKGROUND OF THE INVENTION

1. Field of the Invention

The present invention relates to a seamless connector for attachment to the end of a conductor. In one embodiment, the seamless connector of the present invention is particularly useful for attachment to the end of a shielded coaxial cable for use, for example, in effecting an audio connection.

2. Description of the Prior Art

Heretofore, connectors of the type described herein have been stamped out of flat stock and rolled to form a seamed connector. In use, a lead from a cable such as a coaxial cable has been attached to the connector by folding tabs, which form a part of the connector, over the wire lead of the cable to secure the wire lead in place. For example, FIGS. 1A and 1B depict an example of such a connector 2 depicted with the tabs 4 open and with the tabs 4 folded over a wire lead 6 of a coaxial cable 8,respectively, The fabrication of such a connector 2 has included the two step process of stamping and rolling and has resulted in a connector which inherently includes a seam 10.

It is desirable to provide a connector which may be fabricated in a single step- It is further desirable to provide such a connector which does not require the stamping from flat stock or rolling of the stamped piece. It is also desirable to fabricate a connector which does not include a seam.

SUMMARY OF THE INVENTION

This invention achieves these and other results by providing a connector comprising an elongated seamless tubular member extending along a longitudinal axis and having an outer surface and an inner surface and a first segment and an opposite second segment. The first segment of the connector includes a length which is deformable and comprises a first groove which extends in the direction of the longitudinal axis. Such first groove is indented in the outer surface a distance towards the longitudinal axis. The second segment of the connector may comprise a female connector end or a male connector end.

BRIEF DESCRIPTION OF THE DRAWINGS

This invention may be clearly understood by reference to the attached drawings in which.

DESCRIPTION OF THE PREFERRED EMBODIMENT

Figure 1A:
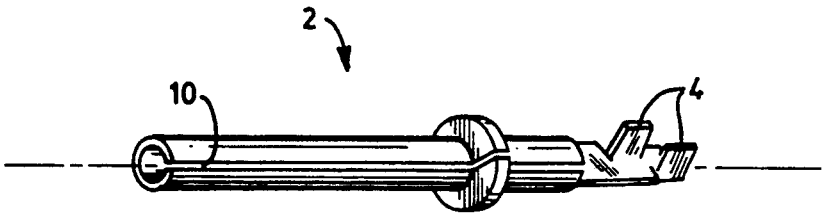
PRIOR ART FIG. 1A
FIGS. 1A and 1B are views of a prior art connector with open and closed tabs, respectively.
Figure 1B:
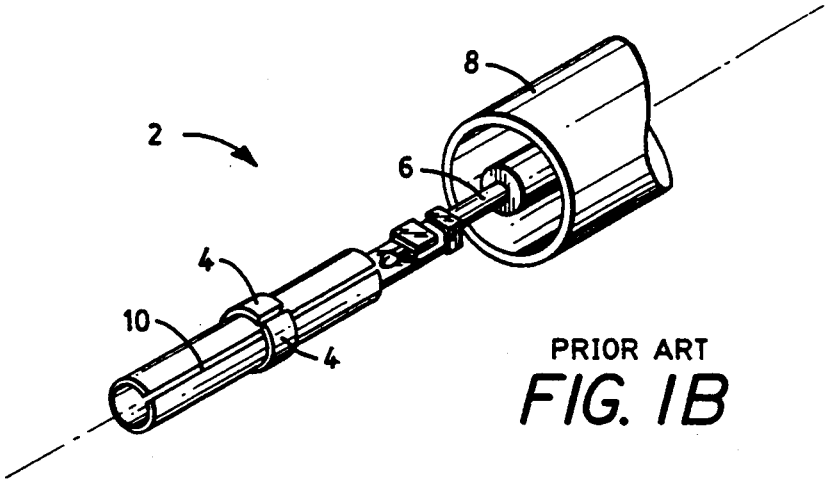
PRIOR ART FIG. 1B
Figure 2:
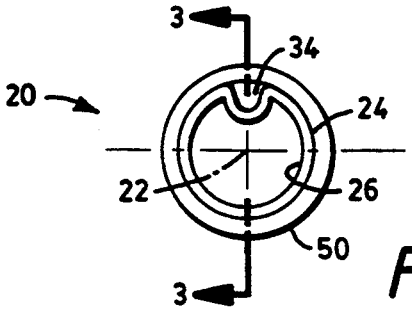
FIGS. 2 is an end view of a male connector embodying the present invention.
Figure 3:
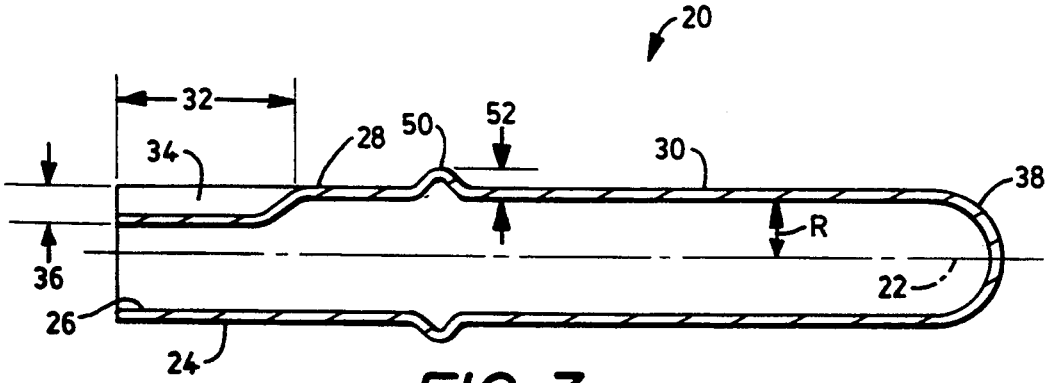
FIG. 3 is a view of FIG. 2 taken along lines 3—3.

The embodiment which is illustrated in the drawings is one which is particularly suited for achieving the objects of this invention. FIGS. 2 and 3 depict a connector in the form of an elongated seamless tubular member 20 extending along a longitudinal axis 22. Connector 20 includes an outer surface 24 and an inner surface 26 and has a first segment 28 and an opposite second segment 30. The first segment 28 includes a length 32 which is deformable and comprises a groove 34 which extends in the direction of axis 22. The groove 34 is indented in the outer surface 24 a distance 36 towards the axis 22. In the preferred embodiment, the distance 36 is less than the radius R of the elongated seamless tubular member. In the preferred embodiment, the elongated seamless tubular member 20 is fabricated from 70/30 brass having a thickness of 0.010 inches using a deep drawing process well known in the art. In the connector of FIGS. 1 and 2 the opposite second segment 30 comprises a male connector end 38.

Figure 5:
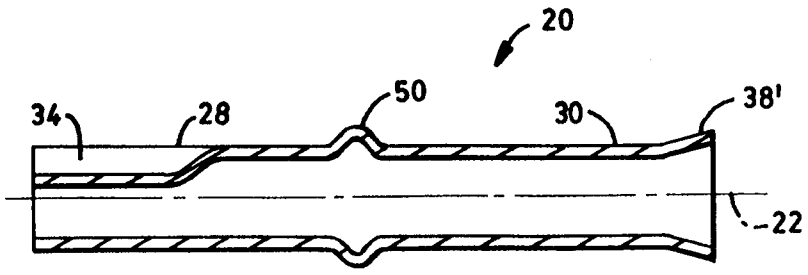
FIG. 5 is a view of FIG. 4 taken along lines 5—5.
Figure 4:
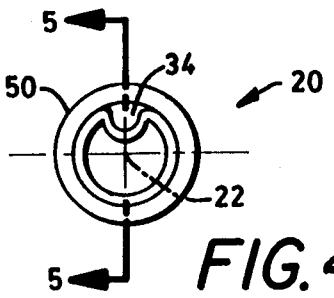
FIG. 4 is an end view of a female connector embodying the present invention.

The connector 20 of FIGS. 4 and 5 is identical to the connector of FIGS. 2 and 3, like reference numerals designating like elements, with the exception that the opposite second segment 30 comprises a female connector end 38'.

Figure 6C:
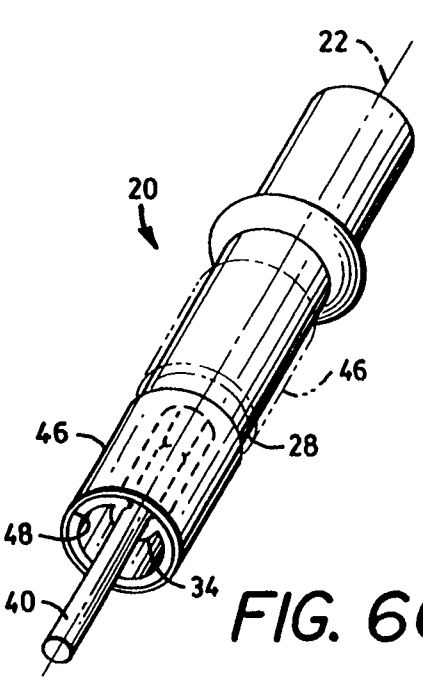
FIGS. 6A, 6B and 6C are views of three different ways of affixing a conductor to a connector of the present invention.
Figure 6B:
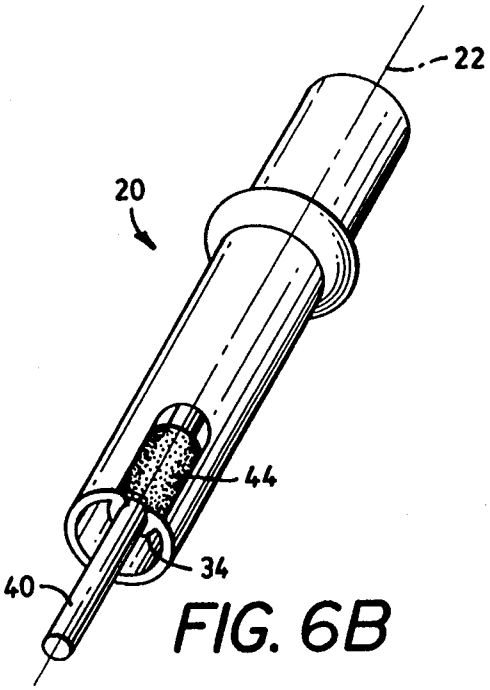
Figure 6A:
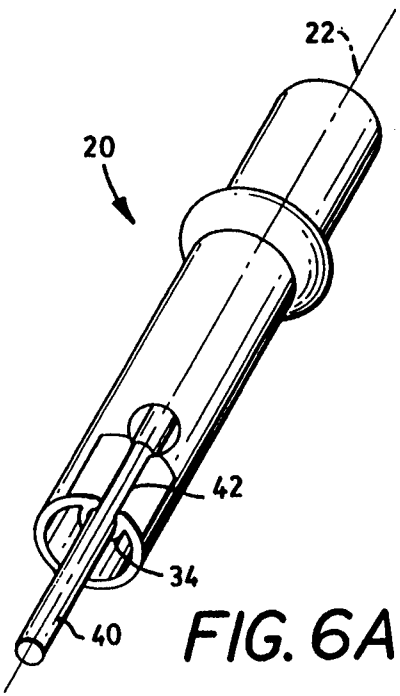

There are at least three different means for attaching a conductor lead 40 to a connector 20. In each case, the conductor lead 40 is inserted into the groove 34 such that the conductor lead engages the base of the groove and extends in the direction of longitudinal axis 22 as depicted in FIGS. 6A to 6C. In one embodiment the length 32 of the first segment 28 of the elongated seamless tubular member 20 is crimped such that the wall 42 of the groove 34 partially envelopes the lead 30 as depicted in FIG. 6A thereby providing a mechanical affixation of the connector to the lead. In a second embodiment the lead 30 is soldered into the groove 34 using solder 44, as depicted in FIG. 6B. In a third embodiment depicted in FIG. 6C, a sleeve 46 is provided. Sleeve 46 is slidable upon the first segment 28 in the direction of axis 22. By providing a sleeve 46 having an inner diameter slightly less than the outer diameter of the first end 28 and having a length which is sufficient to cover all or part of the open portion of the groove 34, the sleeve may be slid from the position depicted in phantom lines to the position depicted in solid lines, as shown in FIG. 6C, to sandwich the lead 40 between the groove 34 and the inner surface 48 of the sleeve 46. Each of the foregoing three embodiments will provide the required electrical connection between the connector 20 and the conductor lead 40.

In the preferred embodiment, the connector 20 will include a circumferentially extending rib 50 disposed between the two opposite ends of the elongated seamless tubular member 20. As depicted in FIG. 3, the rib 50 is indented in the inner surface 26 a distance 52 in a direction away from the longitudinal. axis 22.

Figure 7:
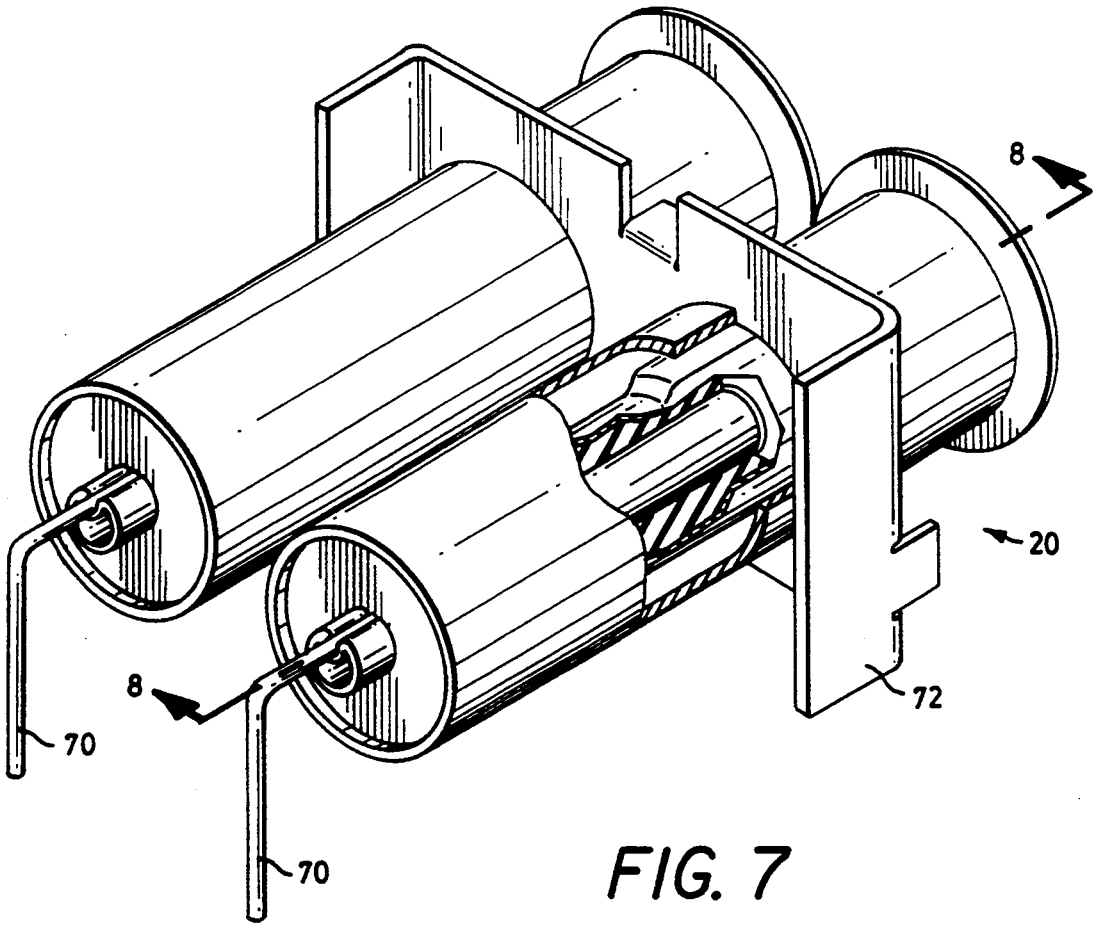
FIG. 7 is a partially cut-away perspective view of another embodiment of the present invention.
Figure 8:
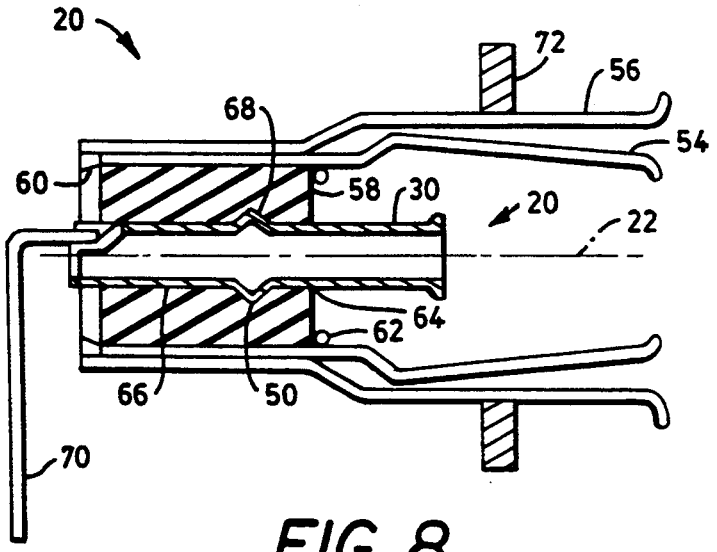
FIG. 8 is a view of FIG. 7 taken along lines 8—8 with the face plate 72 removed.

In the embodiment depicted in FIGS. 7 and 8, each connector 20 comprises an inner connector housing 54 which extends along longitudinal axis 22. Connector 20 further comprises an outer connector housing 56. Inner connector housing 54 is concentric with, connected to and disposed within outer connector housing 56 as depicted in FIG. 8. Preferably, the inner surface of housing 56 is welded to the outer surface of housing 54. A plastic bushing 58 is disposed internal of the inner housing 54 and is attached thereto as, for example, by means of protuberances 60,62 extending from the inner housing 54. The bushing 58 includes a longitudinal bore 64 bounded by a wall 66 and extending along axis 22. An elongated seamless tubular member 20 of the type described with respect to FIGS. 4 and 5 extends in longitudinal bore 64, the outer surface of the tubular member 20 engaging wall 66 as depicted in FIG. 8. The rib 50 mates with a corresponding circumferentially extending groove 68 in wall 66 to hold the connector 20 in place relative to the bushing 58. In the embodiment of FIGS. 7 and 8 the second segment 30 of the elongated seamless tubular member 20 extends away from the plastic bushing 58. In the preferred embodiment, the inner and outer housings 54 and 56 are each fabricated from 70/30 brass having a thickness of 0.015 inches. The bushing 58 is fabricated from plastic such as, for example, Celanex 3310. Each connector 20 is attached to a conductor 70 in the same manner as connector 20 is attached to conductor 40 in FIG. 6A. It will be apparent to those skilled in the art that alternatively the attachment means of FIGS. 6B and 6C may be used, if desired. The composite connector is mounted in the usual manner to a face plate 72. It will also be apparent to those skilled in the art that the female connector 20 depicted in FIGS. 7 and 8 may be replaced by a male connector of the type described with respect to FIGS. 2 and 3, if desired.

Figure 9:
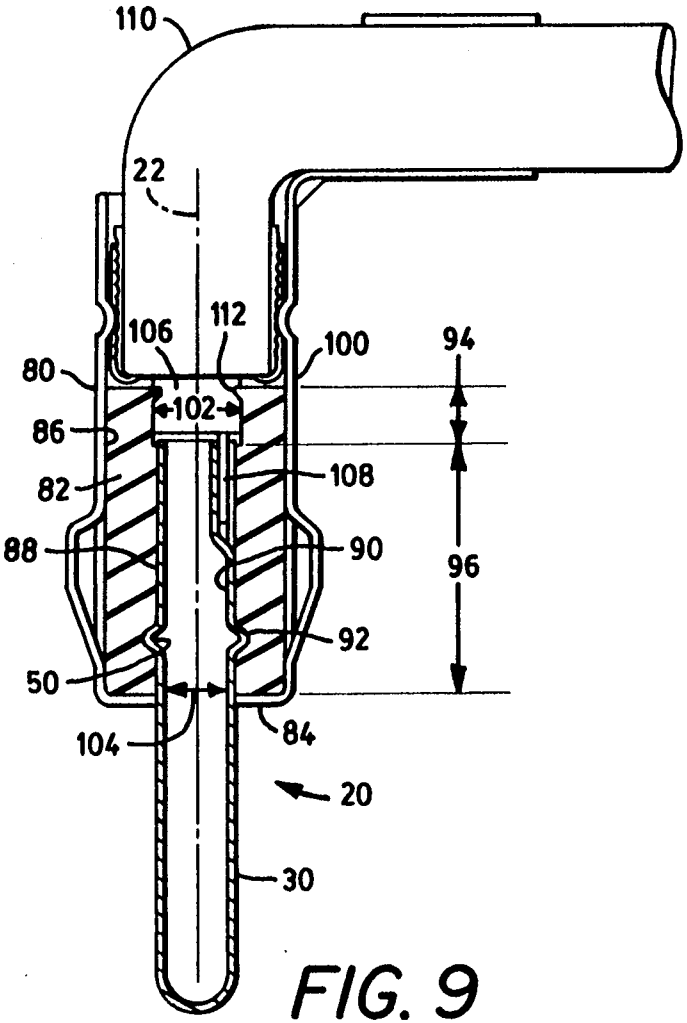
FIG. 9 is a partially cut-away view of another embodiment of the present invention.

In the embodiment of FIG. 9, the connector of the present invention includes a connector housing 80 extending along axis 22 and a plastic bushing 82 internal of the housing 80 and attached thereto by the end 84 of the housing and by staking at preferably three positions 86 (only one is shown) equally spaced circumferentially of the outer surface of the housing. Plastic bushing 82 includes a longitudinal bore 88 bounded by a wall 90, the bore extending along axis 22. An elongated seamless tubular member 20 of the male-type described with respect to FIGS. 2 and 3 extends in bore 88 such that the outer surface of the male-type elongated seamless tubular member engages the wall 90 as depicted in FIG. 9. The rib 50 mates with a corresponding circumferentially extending groove 92 in wall 90 to hold the elongated seamless tubular member 20 in place relative to the bushing 82. Longitudinal bore 88 includes a first length 94 defined by a first bore wall and a second length 96 defined by a second bore wall, the first length 94 being disposed at one end 100 of the bore 88 and having a diameter 102 greater than the diameter 104 of the second length 96. The first segment 28 of the elongated seamless tubular member 20 is disposed within the second length 96 of bore 88 as depicted in FIG. 9. In the preferred embodiment, the diameter 102 is substantially equal to the diameter of an insulator 106 of a lead 108 of an electrical cable such as coaxial cable 110, such that the lead insulator 106 may be inserted into the first length 94 as depicted in FIG. 9. 1 At least one protuberance 112 extends from the first bore wall towards longitudinal axis 22 to pinch the lead insulator 106 and hold it in place relative to bushing 82. As depicted in FIG. 9, the second segment 30 of the elongated seamless tubular member is in the form of a male connector which extends away from the bushing 82 at an end of the bushing adjacent second length 96. In the preferred embodiment, the connector of FIG. 9 is fabricated from the same materials as the other embodiments described herein, the housing 80 being 70/30 brass having a thickness of 0.010 inches, the tubular member 20 being 70/30 brass having a thickness of 0.015 inches, and the bushing 82 being fabricated from celanex 3310.

Figure 10:
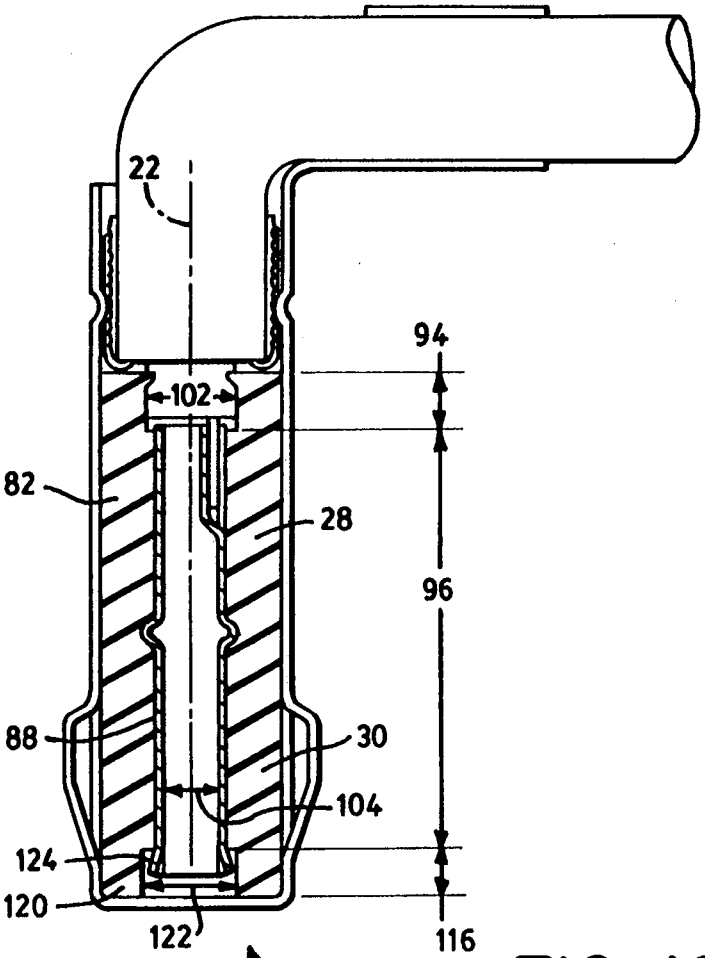
FIG. 10 is a partially cut-away view of another embodiment of the present invention.

The embodiment of FIG. 10 is identical to the embodiment of FIG. 9, like reference numerals referring to like elements, except for the exceptions noted herein. First, a female-type elongated seamless tubular member 20 of the type depicted in FIGS. 4 and 5 replaces the male-type elongated seamless tubular member of FIG. 9. In addition, the bushing 82 is somewhat longer than that of FIG. 9 to accommodate the female-type tubular member 20 as depicted in FIG. 10. Further, the longitudinal bore 88 includes a third length 116 defined by a third bore wall , the third length being disposed at an opposite end 120 of the longitudinal bore 88 and having a diameter 122 greater than diameter 104 of the second length 96. In this embodiment, the second length 96 is disposed between the first length 94 and the third length 116. In this manner, the first end 28 and second end 30 of the elongated seamless tubular member 20 of FIGS. 4 and 5 are substantially disposed within the second length 96 of the bore 88. As depicted in FIG. 10, the distal end of the second end 30 of the elongated seamless tubular member 20 includes an end portion 124 which is flared outwardly relative to axis 22, end portion 124 being disposed in the third length 116. In the preferred embodiment, the connector of FIG. 10 is fabricated from the same materials as the embodiments of FIG. 9.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A connector comprising an elongated seamless tubular member extending along a longitudinal axis and having an outer surface and an inner surface and a first segment and an opposite second segment, said first segment having a length which is deformable and comprises a first groove which extends in the direction of said longitudinal axis, said first groove being indented in said outer surface a distance towards said longitudinal axis.

2. The connector of claim 1 wherein said second segment comprises a female connector end.

3. The connector of claim 1 wherein said second segment comprises a male connector end.

4. The connector of claim 1 further comprising a circumferentially extending rib disposed between said length and an end of said elongated seamless tubular member, said rib being indented in said inner surface a distance in a direction extending away from said longitudinal axis.

5. The connector of claim 1 wherein said distance is less than the radius of said elongated seamless tubular member.

6. The connector of claim 1 further comprising a first connector housing extending along said longitudinal axis, and a plastic bushing internal of said first housing and attached to said first housing, said plastic bushing having a longitudinal bore bounded by a wall and extending along said first longitudinal axis, said elongated seamless tubular member extending in said longitudinal bore, said outer surface of said elongated seamless tubular member engaging said wall.

7. The connector of claim 6 wherein said elongated seamless tubular member comprises a circumferentially extending rib disposed between said length and an end of said elongated seamless tubular member, said rib being indented in said inner surface a distance in a direction extending away from said longitudinal axis, said rib mating with a corresponding circumferentially extending second groove in said wall.

8. The connector of claim 6 further comprising a second connector housing, said first connector housing being concentric with, connected to and disposed within said second connector housing.

9. The connector of claim 8 wherein said elongated seamless tubular member comprises a circumferentially extending rib disposed between said length and an end of said elongated seamless tubular member, said rib being indented in said inner surface a distance in a direction extending away from said longitudinal axis, said rib mating with a corresponding circumferentially extending second groove in said wall.

10. The connector of claim 9 wherein said second segment of said elongated seamless tubular member extends away from said plastic bushing.

11. The connector of claim 7 wherein said longitudinal bore includes a first length defined by a first bore wall and a second length defined by a second bore wall, said first length being disposed at one end of said longitudinal bore and having a diameter greater than a diameter of said second length.

12. The connector of claim 11 wherein said first segment of said elongated seamless tubular member is disposed within said second length.

13. The connector of claim 12 wherein said diameter of said first length is substantially equal to the diameter of a lead insulator of an electrical cable to be inserted into said first length.

14. The connector of claim 13 further including at least one protuberance extending from said first bore wall towards said longitudinal axis.

15. The connector of claim 14 wherein said second end of said elongated seamless tubular member is in the form of a male connector which extends away from said plastic bushing at an end of said plastic bushing adjacent said second length.

16. The connector of claim 14 wherein said longitudinal bore includes a third length defined by a third bore wall, said third length being disposed at an opposite end of said longitudinal bore and having a diameter greater than said diameter of said second length, said second length being disposed between said first length and said third length.

17. The connector of claim 16 further wherein said second segment of said elongated seamless tubular member is substantially disposed within said second length.

18. The connector of claim 17 wherein a distal end of said second segment of said elongated seamless tubular member comprises an end portion which is flared outwardly relative to said longitudinal axis, said end portion being disposed in said third length.

19. The connector of claim 1 further comprising a sleeve in engagement with and slideable relative to said outer surface at said first segment.

* * * * *